US006739972B2

(12) United States Patent
Flanagan-Parks et al.

(10) Patent No.: US 6,739,972 B2
(45) Date of Patent: May 25, 2004

(54) CREDIT SYSTEM FOR GAMING MACHINES AND GAMING TABLES

(75) Inventors: Collette Flanagan-Parks, Dallas, TX (US); Bernard S. Hanyard, Duncanville, TX (US)

(73) Assignee: CSR Partnership, Amarillo, TX (US)

( * ) Notice: Subject to any disclaimer, the term of this patent is extended or adjusted under 35 U.S.C. 154(b) by 0 days.

(21) Appl. No.: 09/874,518

(22) Filed: Jun. 4, 2001

(65) Prior Publication Data

US 2002/0183110 A1 Dec. 5, 2002

(51) Int. Cl.[7] ..... A63F 9/24
(52) U.S. Cl. ..... 463/25; 235/380; 902/23
(58) Field of Search ..... 463/1, 20, 25, 463/29, 30, 31, 37, 40, 42; 235/380; 902/23

(56) References Cited

U.S. PATENT DOCUMENTS 5,038,022 A * 8/1991 Lucero ..... 463/25
5,559,312 A * 9/1996 Lucero ..... 463/25
5,811,772 A * 9/1998 Lucero ..... 463/25 X
5,902,983 A * 5/1999 Crevelt et al. ..... 235/380
5,919,091 A * 7/1999 Bell et al. ..... 463/25
6,368,216 B1 * 4/2002 Hedrick et al. ..... 463/20

FOREIGN PATENT DOCUMENTS

GB 2321125 * 7/1998

* cited by examiner

*Primary Examiner*—Tony M. Argenbright
(74) *Attorney, Agent, or Firm*—Michael A. O'Neil

(57) ABSTRACT

A gaming machine of the type having a credit register is provided with a financial card reader and a display and data input apparatus which are utilized to establish communication between the gaming machine and a credit source and to transfer credit from the credit source to the credit register of the gaming machine. A gaming table is provided with a credit voucher printer, a credit register, a financial card reader, and a display and data input apparatus. The financial card reader and the display and data input apparatus are utilized to establish communication between the gaming table and a credit source and to transfer a requested credit amount from the credit source to the credit register of the gaming table whereupon the credit voucher printer is utilized to print a credit voucher having a value equal to the amount of credit stored in the credit register.

6 Claims, 4 Drawing Sheets

CREDIT SYSTEM FOR GAMING MACHINES AND GAMING TABLES

TECHNICAL FIELD

This invention relates generally to facilitating play at gaming machines and gaming tables, and more particularly to a method of and apparatus for establishing credit at the site of a gaming machine or a gaming table.

BACKGROUND AND SUMMARY OF THE INVENTION

People throughout the world enjoy playing slot machines and other gaming machines at casinos and similar venues. Often a player will select a particular gaming machine and thereafter play the selected machine for an extended period of time thinking that by so doing the chances of winning a large jackpot are increased.

At the present time, however, if the player runs low on cash, it is necessary for the player leave the selected gaming machine in order to obtain additional cash, for example, from an ATM machine. Meanwhile, another player may take over the selected machine and win a jackpot in a relatively short time, much to the dismay of the original player.

Similar circumstances occur at gaming tables such as roulette tables, craps tables, blackjack tables, etc. A player at a gaming table that runs short of cash has two options available. One possibility is to leave the table in order to obtain cash from an ATM machine or other source. This opens the possibility that another player will take over the vacated seat at the gaming table. The other possibility is to obtain cash from the gaming table operator by signing a marker. The latter procedure is inconvenient in that it often requires as much as 15 minutes or more to complete.

The present invention comprises a credit system for gaming machines and gaming tables which overcomes the foregoing and other difficulties which long since characterized the prior art. In accordance with the broader aspects of the invention, individual gaming machines and gaming tables are provided with credit authorization facilities. More specifically, individual gaming machines and individual gaming tables are provided with financial card readers and associated display and data input apparatus. As used herein the term "financial card" means an ATM card, a credit card, a debit card, or any other type of card which facilitates communication with a credit source for purposes of establishing credit.

In accordance with the invention, a player utilizing a gaming machine or a gaming table utilizes the financial card reader located at the gaming machine or gaming table and the associated display and data input apparatus to establish communication with the credit source. The credit source in turn authorizes the requested credit. In the case of a gaming machine, the credit card is entered into the credit register of the machine thereby facilitating play. In the case of a gaming table, a printer located at the gaming table generates a voucher which is exchanged for chips. In this manner a player utilizing a particular gaming machine or gaming table can obtain credit without leaving the gaming device or gaming table and without waiting for a marker to be authorized.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
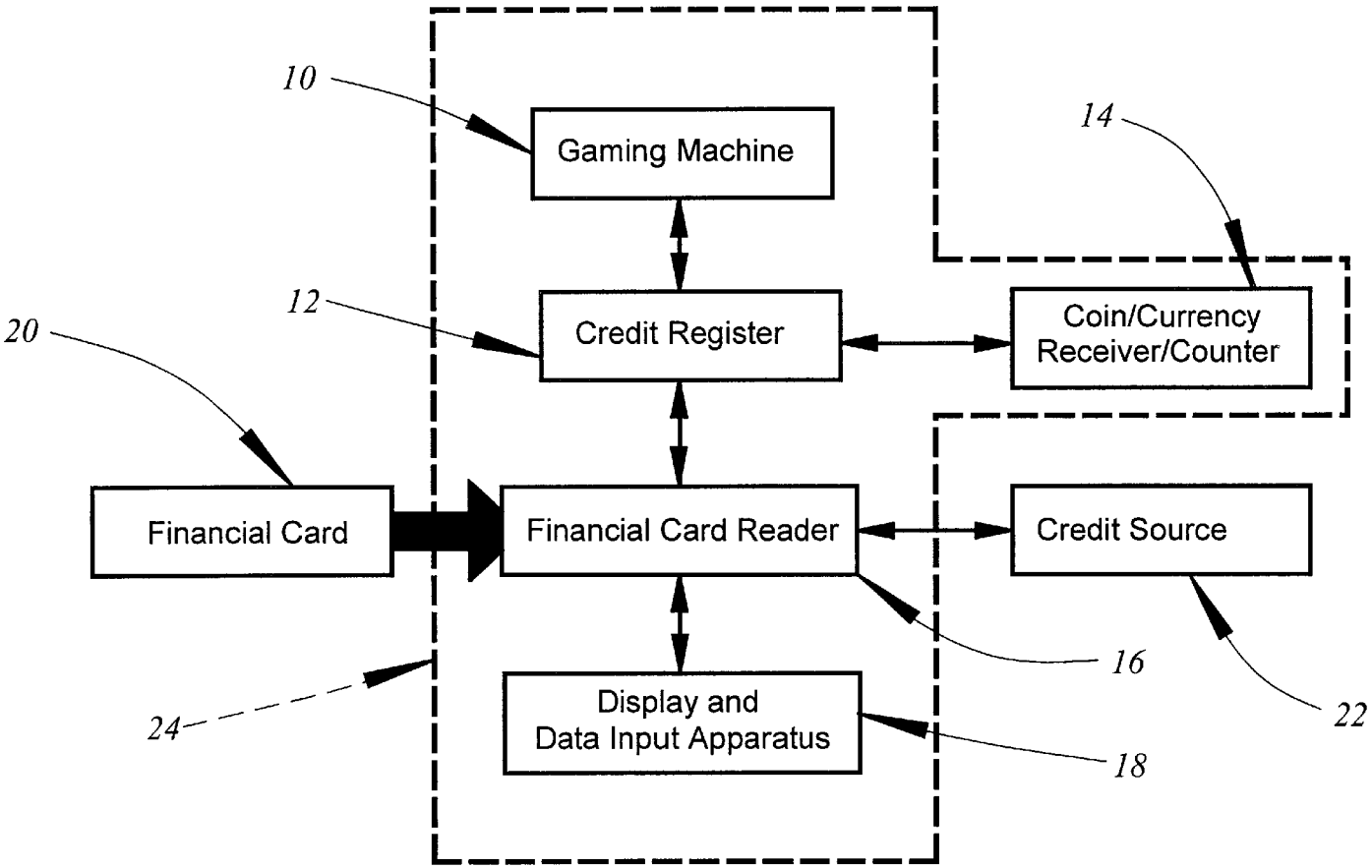
FIG. 1 is a diagrammatic illustration of the first embodiment of the apparatus of the present invention.

The first embodiment of the apparatus of the present invention is illustrated in FIG. 1. A gaming machine 10 can comprise a slot machine or any other conventional gaming machine or device. The gaming machine 10 is provided with a credit register 12 which controls the operation of the gaming machine 10. The gaming machine 10 is also provided with a coin/currency receiver/counter 14 the function of which is to receive, authenticate, and determine the value of coins and/or currency received therein.

In order to play the gaming machine 10, a player may deposit coins and/or currency into the coin/currency receiver/counter 14. The value of the coins and/or currency deposited is communicated from the coin/currency receiver/counter 14 to the credit register 12 thereby establishing a credit balance in the credit register in the amount of the value of the deposited coins and/or currency. Whenever there is a credit balance in the credit register 12, play of the gaming machine 10 is facilitated.

As play continues, winnings resulted from play of the gaming machine 10 are added to the credit balance in the credit register 12. Similarly, losses resulting from play of the gaming machine are deducted from the credit balance in the credit register 12. If losses continue until the balance in the credit register is zero or nil, the credit register 12 disables the gaming machine 10.

In accordance with the present invention, the gaming machine 10 is provided with a financial card reader 16 individual to and located at the site of the gaming machine 10. As used herein the term "financial card" means an ATM card, a credit card, a debit card, or any other type of card which may be utilized to establish communication with a credit source for the purpose of obtaining credit.

The financial card reader 16 is in turn provided with a display and data input apparatus 18 which is utilized with and individual to the financial card reader 16. As will be appreciated by those skilled in the art, the display and data input apparatus 18 may comprise a CRT display, an LCD display, and LED display or any of the various other types of displays that are commonly utilized in association with ATM machines, computers, and the like. Likewise, the display and data input apparatus 18 may comprise a 10 key keyboard or any of the various other input devices commonly utilized in conjunction with ATM machines, computers, and the like.

Assume now that a player wishes to play the gaming machine 10 but does not have sufficient cash available to do so. The player inserts a financial card 20 into the financial card reader and in conjunction therewith operates the display and data input apparatus 18 to establish communication with a credit source. As used herein the term "credit source" means an entity that can and will issue credit to the bearer of the financial card 20 responsive to various predetermined conditions, and is not limited to the entity which actually provided the financial card 20.

After establishing communication with the credit source 22, the player utilizes the display and data input apparatus 18 to indicate the amount of credit requested. Assuming that the various conditions necessary for the authorization of credit in the amount requested are met, the credit source 22 communicates a credit authorization through the financial card reader 16. In most cases the credit authorization results in a simultaneous deduction of the requested credit amount from an account maintained by the owner of the financial card 20 with the credit source 22.

Unlike an ATM machine, receipt by the financial card reader of a credit authorization does not result in the issuance of currency. Rather, the requested credit amount as authorized by the credit source 22 is added to the credit register 12, thereby facilitating play of the gaming machine 10.

Assume further that the player that is utilizing the gaming machine 10 has been successful and the resulting winnings have been accumulated in the credit register 12. If the player wishes to discontinue playing the gaming machine 10, the player actuates the gaming machine to cash out. The term "cash out" is used herein in the same way that it is used in the gaming industry to mean giving the player coins, currency, and/or a voucher equal in value to the value stored in the credit register, and simultaneously debiting the credit register to zero.

The component parts of the credit system for gaming machines comprising the first embodiment of the invention are preferably housed in a unitary housing 24. In the case of a new gaming machine the housing 24 would be coincident with the housing of the gaming machine 10. In the case of existing gaming devices, the housing 24 could be an attachment to the housing of the gaming machine 10 or a separate structure positioned immediately adjacent to and secured to the housing of a gaming machine 10. As will be appreciated by those skilled in the art, when the present invention is utilized in conjunction with a gaming machine, the use of the coin/currency receiver/counter 14 can be dispensed with entirely.

Although the gaming machine 10, the credit register 12, the financial card reader 16, and the display and data input apparatus 18 are depicted as separate structures in FIG. 1, those skilled in the art will appreciate the fact that there may be overlap in structure and function among the various components. For example, modern gaming machines are typically provided with a player's card slot which receives a player's card which records activities of the player at a particular casino or similar venue in a manner similar to a frequent flyer account with an airline. In accordance with the present invention it is contemplated that the player's card slot of the gaming machine can also function as the financial card reader. As is also well known, modern gaming machines include numerous electronic displays which can be utilized as part of the display and data input apparatus. Data input devices normally utilized in operating the gaming machine can also be incorporated as part of the display and data input apparatus.

Figure 2:
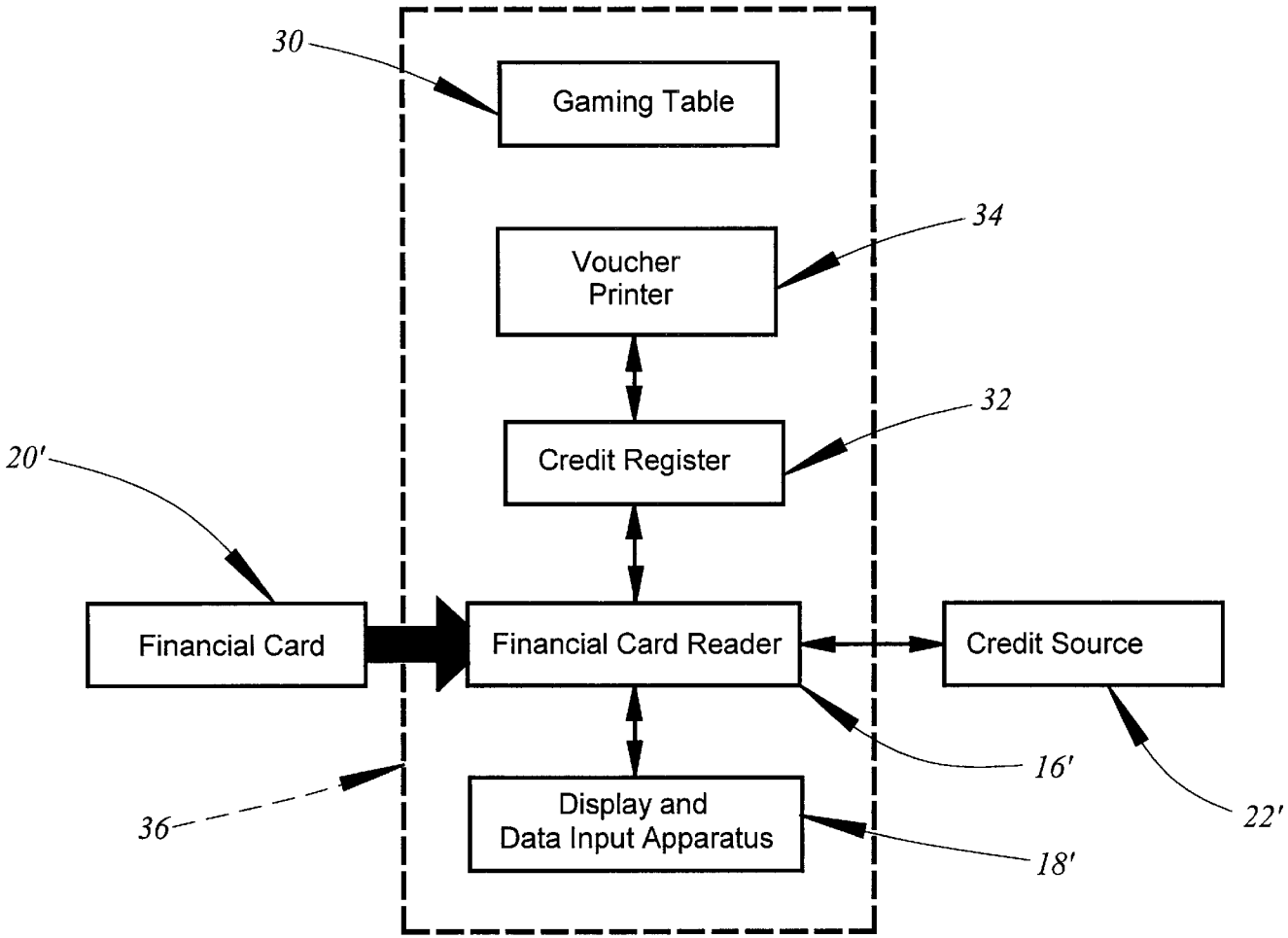
FIG. 2 is a diagrammatic illustration of the second embodiment of the apparatus of the invention.

The second embodiment of the apparatus of the present invention is illustrated in FIG. 2. Certain of the components parts of the second embodiment of the apparatus of the invention are substantially identical in construction and function to component parts of the first embodimennt of the apparatus of the invention as illustrated in FIG. 1 and described hereinabove in conjunction therewith. Such identical component parts are designated in FIG. 2 with the same reference numerals utilized in the description thereof in conjunction with FIG. 1, but are differentiated thereof by a prime (') designation.

The second embodiment of the apparatus of the present invention is utilized in conjunction with a gaming table 30 which may comprise a roulette table, a craps table, a blackjack table, or any other conventional gaming table. A financial card reader 16' is individual to and utilized solely in conjunction with an individual gaming table 30. A display and data input apparatus 18' is utilized in conjunction with and is individual to the financial card reader 16'.

In the use of the second embodiment of the apparatus of the invention, a player seated at the gaming table 30 may need to purchase chips to begin or continue play. In any such event the player inserts his financial card 20' into the financial card reader 16' and utilizes the display and data input apparatus 18' to establish communication with the credit source 22'. When communication is established, the player utilizes the display and input device to communicate the amount of desired credit to the credit source 22'.

Assuming that the predetermined conditions for the issuance of credit to the owner of the financial card 20' are fulfilled, the credit source 22' transmits an authorization of the requested credit amount to the financial card reader 16' which in turn relays the authorization to a credit register 32 wherein the value of the authorized credit is stored. The value of the authorized credit is transmitted from the credit register to a voucher printer 34. The voucher printer prints a voucher for the amount of the credit requested by the owner of the financial card 20' and authorized by the credit source 22'. Simultaneously, the voucher printer 34 sends a signal to the credit register 32 cancelling the credit amount previously stored therein. The voucher is exchanged for chips which allows the player to begin or continue playing at the gaming table 30.

It is contemplated that the component parts of the second embodiment of the apparatus of the present invention are contained within a unitary housing 36. In the case of a new gaming table 30, the housing 36 would be coincident with the structure of the gaming table. In the case of an existing gaming table 30, the housing 36 could comprise a separate structure secured to and operatively connected to the gaming table 30.

Figure 3:
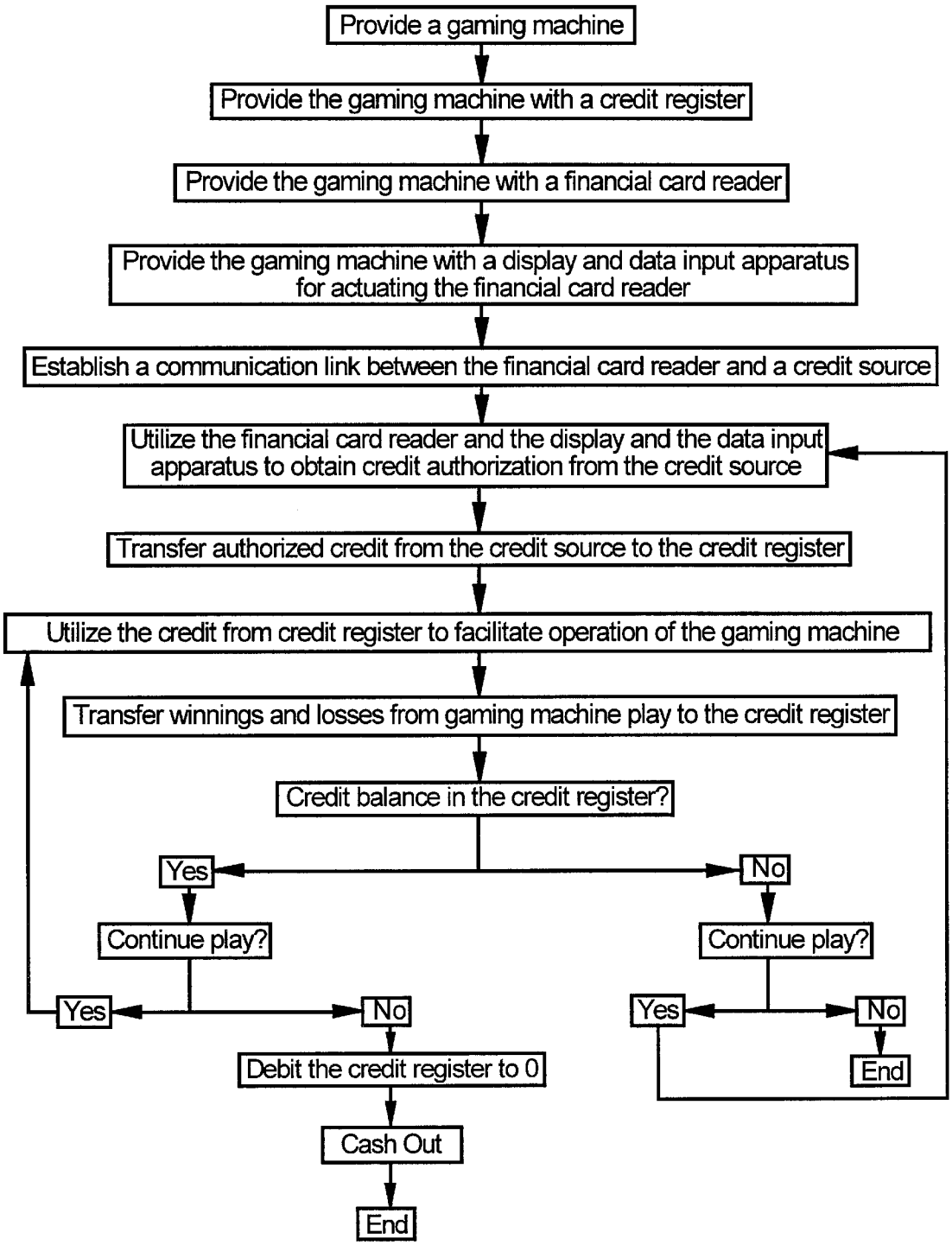
FIG. 3 is a flowchart illustrating the first embodiment of the method of the invention.

The first embodiment of the method of the present invention is illustrated in FIG. 3. In accordance with the first embodiment of the method, there is provided a gaming machine having a credit register operatively associated therewith. The gaming machine is provided with a financial card reader which is individual to and utilized solely in conjunction with the gaming machine. The gaming machine is further provided with a display and data input apparatus which is utilized to actuate the financial card reader.

In accordance with the first embodiment of the method of the invention, a player wishing to obtain credit for use in operating the gaming machine inserts a financial card into the financial card reader and thereafter utilizes the financial card reader and the display and data input apparatus to obtain credit authorization from the credit source. More specifically, the financial card reader and the display and data input apparatus are utilized to request authorization of a specific credit amount from the credit source.

Assuming the predetermined conditions are satisfied, the credit source authorizes credit in the requested amount. The authorized credit is transferred from the credit source to the credit register of the gaming machine. The transfer step may be accomplished utilizing the facilities of the financial reader.

After the requested credit has been transferred from the account of the financial card owner with the credit source to the credit register of the gaming machine, a credit card owner plays the gaming machine. Winnings and losses resulting from the play of the gaming device are transferred from the gaming machine to the credit card register. To the extent that a credit balance is maintained in the credit register, the player has the option of either continuing or discontinuing play. In the event play is discontinued, the player actuates the gaming machine to cash out.

If the play of the gaming device by the owner of the financial card results in losses which reduce the balance of the credit register of the gaming device to zero, the player can decide either to continue play or to quit play. In the event the owner of the financial card elects to continue play, the financial card and the display and data input apparatus are once again utilized to obtain credit from the credit card issuer.

Figure 4:
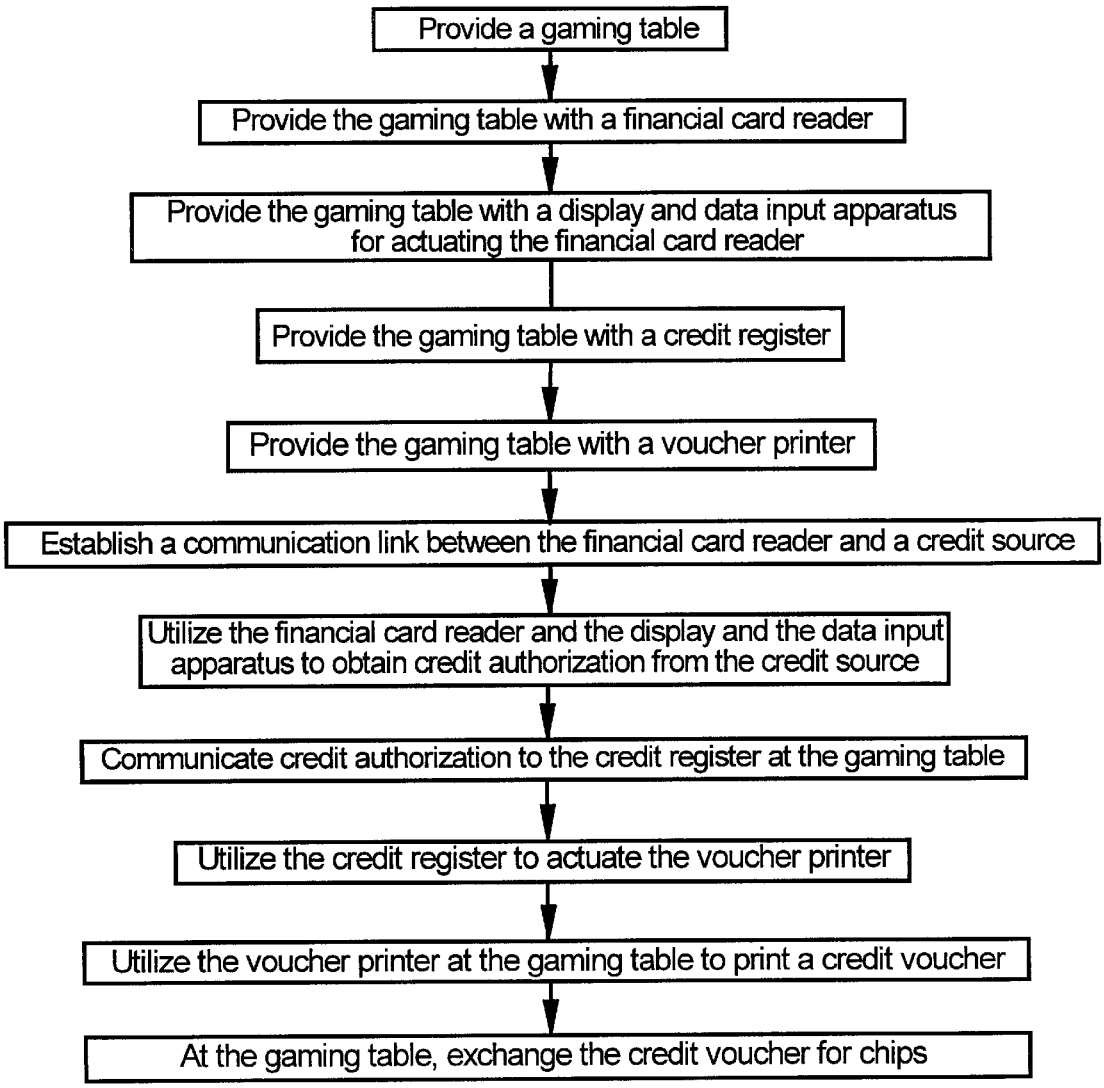
FIG. 4 is a flowchart illustrating the second embodiment of the method of the invention.

The second embodiment of the method of the invention is illustrated in FIG. 4. In accordance with the second embodiment of the invention, a gaming table is provided with a financial card reader and an associated display and data input apparatus. The gaming table is also provided with a voucher printer.

In the event the owner of a financial card requires credit either to begin or continue play at the gaming table, the financial card and the display and data input apparatus are utilized to establish a communication link between the financial card reader and the credit source, and to request a designated amount of credit from the credit source. Assuming that predetermined conditions are established, the credit source establishes credit in the requested amount and subtracts the requested amount of credit from the account of the financial card owner with the credit source. The requested credit authorization is communicated from the credit source through the financial card reader to the credit register at the gaming table. The credit register then actuates the voucher printer to print a credit voucher on behalf of the financial card owner. Simultaneously with the printing step, the voucher printer sends a signal tot he credit register which cancels the credit amount previously stored therein. At the gaming table the financial card owner exchanges the credit voucher for chips thereby facilitating play at the gaming table.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A credit system for gaming tables comprising:

a gaming table;

a credit register individual to the gaming table;

a voucher printer individual to the gaming table and operatively connected to the credit register thereof for printing credit vouchers having a value equal to the amount of credit stored in the credit register;

a financial card reader individual to the gaming table;

a display and data input device individual to and operatively connected to the financial card reader for use in conjunction therewith for establishing communication with a credit source and for transferring a credit amount from the credit source to the credit register of the gaming table to facilitate operation of the credit voucher printer of the gaming table to print a credit voucher having a value equal to the amount of credit transferred from the credit source to the credit register.

2. The credit system according to claim 1 wherein the gaming table has a support structure and wherein the credit voucher printer, the credit register, the financial card reader, and the display and data input apparatus are mounted within the support structure of the gaming table.

3. The credit system according to claim 1 wherein the gaming table has a support structure and wherein the credit voucher printer, the credit register, the financial card reader, and the display and data input apparatus are mounted within a housing which is secured to the support structure of the gaming table.

4. A method of providing credit at a gaming table including the steps of:

providing the game table;

providing a credit voucher printer individual to and located at the site of the gaming table;

providing a credit register individual to and located at the site of the gaming table;

providing a financial card reader individual to and located at the site of the gaming table;

providing a display and data input apparatus individual to and located at the site of the gaming table;

utilizing the financial card reader and display and data input apparatus to establish communication with a credit source and to transfer a requested credit amount from the credit source to the credit register; and thereafter utilizing the credit voucher printer to print a credit voucher having a value equal to the amount of credit stored in the credit register.

5. The method according to claim 4 wherein the step of providing a gaming table is further characterized by the step of providing a gaming table having a support structure and including the additional step of mounting the credit voucher printer, the credit register, the financial card reader, and the display and data input apparatus within the housing of the gaming table.

6. The method according to claim 4 wherein the step of providing a gaming table is further characterized by providing a gaming table having a support structure and including the additional steps of mounting the credit voucher printer, the credit register, the financial card reader, and the display and data input apparatus in a housing and securing the housing to the support structure of the gaming table.

* * * * *